US011241732B2

(12) United States Patent
Lee et al.

(10) Patent No.: US 11,241,732 B2
(45) Date of Patent: Feb. 8, 2022

(54) CASTING PRODUCT WITH TUBULAR FLOW PASSAGES, METHOD OF CASTING THE SAME PRODUCT, AND CAST-IN PIPE INSERT UNIT

(71) Applicants: HYUNDAI MOTOR COMPANY, Seoul (KR); KIA MOTORS CORPORATION, Seoul (KR); SAMBO MOTORS CO., LTD., Daegu (KR)

(72) Inventors: Yoon-Ki Lee, Suwon-si (KR); Hyung-Sop Yoon, Yongin-si (KR); Cheol-Ung Lee, Hwaseong-si (KR); Jae-Gi Sim, Seoul (KR); Jun Bak, Daegu (KR); Sang-Muk Park, Daegu (KR); Sung-Chun Jang, Daegu (KR); Jin-Hee Lee, Daegu (KR); Young-Han No, Daegu (KR); Young-Jae Do, Daegu (KR)

(73) Assignees: Hyundai Motor Company, Seoul (KR); Kia Motors Corporation, Seoul (KR); Sambo Motors Co Ltd, Daegu (KR)

( * ) Notice: Subject to any disclaimer, the term of this patent is extended or adjusted under 35 U.S.C. 154(b) by 23 days.

(21) Appl. No.: 16/696,630

(22) Filed: Nov. 26, 2019

(65) Prior Publication Data

US 2020/0353534 A1 Nov. 12, 2020

(30) Foreign Application Priority Data

May 7, 2019 (KR) ..... 10-2019-0053070

(51) Int. Cl.
*B22D 17/24* (2006.01)
*B22D 17/00* (2006.01)
(Continued)

(52) U.S. Cl.
CPC ..... *B22D 17/24* (2013.01); *B22D 17/002* (2013.01); *B22D 17/2236* (2013.01); *B22D 17/2263* (2013.01); *B22D 19/0072* (2013.01)

(58) Field of Classification Search
CPC ..... B22D 17/24; B22D 19/0072
See application file for complete search history.

(56) References Cited

U.S. PATENT DOCUMENTS 3,439,732 A * 4/1969 Andreoli ..... F28F 9/266 164/112
2020/0254515 A1* 8/2020 Gobel ..... B22D 19/0072

FOREIGN PATENT DOCUMENTS

DE 19539646 C1 * 1/1997 ..... B22D 19/0072
FR 2708495 A1 * 2/1995 ..... F16H 61/00
(Continued)

*Primary Examiner* — Kevin E Yoon
*Assistant Examiner* — Jacky Yuen
(74) *Attorney, Agent, or Firm* — Morgan, Lewis & Bockius LLP

(57) ABSTRACT

A method of casting a casting product having tubular flow passages includes: attaching a cast-in pipe insert, having outer and inner fixing members to which both ends of pipes are coupled, respectively, to a fixed mold; assembling a movable mold with the fixed mold; injecting a molten metal into a cavity defined inside the fixed and movable molds; ejecting a casting product from the assembled molds after injecting the molten metal; and removing the outer and inner fixing members from the casting product.

4 Claims, 18 Drawing Sheets

(51) Int. Cl.
*B22D 17/22* (2006.01)
*B22D 19/00* (2006.01)

(56) References Cited

FOREIGN PATENT DOCUMENTS

| | | | |
|---|---|---|---|
| KR | 2000-0017994 | A | 4/2000 |
| KR | 10-1705170 | B1 | 2/2017 |

* cited by examiner

CASTING PRODUCT WITH TUBULAR FLOW PASSAGES, METHOD OF CASTING THE SAME PRODUCT, AND CAST-IN PIPE INSERT UNIT

CROSS-REFERENCE(S) TO RELATED APPLICATIONS

This application claims priority to Korean Patent Application No. 10-2019-0053070, filed on May 7, 2019, the disclosure of which is incorporated herein by reference in its entirety.

TECHNICAL FIELD

The present disclosure relates to a casting product with tubular flow passages, a method of casting the product and a cast-in pipe insert unit used therein.

BACKGROUND

In the case of a transmission housing of a vehicle, abrasion resistance, rigidity and airtightness are required in a composite manner. Therefore, combination of aluminum and steel products has been used for the transmission housing.

Recently, as the development of aluminum materials and design technology has progressed, the transmission housing has been developed as an aluminum integrated housing that can be lightened. However, design of such transmission housing is constrained because it is difficult to reflect intricate internal flow passages thereto.

An example of parts having intricate flow passages includes a retainer. In the case of a retainer having a hollow formed therein, considerable design constraints are imposed on formation of flow passages in parts such as a retainer having an end being communicated fluidly with the hollow.

FIGS. 1 and 2 show conventional examples for reflecting a flow passage with respect to a hollow of a retainer, wherein the FIG. 1 shows a method of sealing portions machined for finishing the flow passage with balls after aluminum casting, and FIG. 2 shows a method of press-fitting a separate outer sleeve.

The prior art shown in FIG. 1 is a method of sealing a transmission housing with balls 1 after machining in two directions. When machining the flow passage 2 into a straight form, interference with the machining portions occurs and it is difficult to perform machining work because space for a machining tool is not secured. In addition, it is difficult to manage process and there is also a possibility of occurrence of leakage because twelve balls are used for sealing.

FIG. 2 shows a method of machining a straight flow passage 4 and then press-fitting the sleeve 5 after casting an integral drum 3. This has a problem in that a total length of the retainer is increased because an extra space for press-fitting the sleeve must be secured and that there is also a possibility of occurrence of leakage.

On the other hand, in the case of a steel drum, processes for press-fitting and welding three parts, i.e., the steel drum, the steel sleeve and an aluminum boss are required.

Both the methods require a separate processing of the flow passage after casting. In view of the characteristics inherent in the internal quality of a high-pressure casting product, portions to be machined as the flow passages are thick portions and thus pores may be possibly distributed in the thick portion, resulting in a leakage problem. Further, there is also a possibility of occurrence of a gap between the press-fitted balls and the outer sleeve and the retainer because torsion or shock is exerted thereon due to the load that occurs during operation, which is caused by the nature of the retainer that is the housing for supporting a clutch. Therefore, in view of this point, it is not completely free from a leakage problem. Moreover, an assembling process is also complicated because of addition of separate parts such as press-fitted balls and the outer sleeve.

Still further, in the case of a casting product in which a hollow is formed, it is also impossible to cast the product with pipes inserted as cast-in inserts for forming flow passages that fluidly communicate with the hollow since it is impossible to fix the pipes to be inserted.

As the foregoing described in the background section is to promote better understanding of the background of the present disclosure, it may include matters not falling within the prior art well known to those who have ordinary skill in the art.

SUMMARY OF THE DISCLOSURE

The present disclosure has been made in effort to solve the above-described problems associated with the prior art. It is an object of the present disclosure to provide a casting product having tubular flow passages capable of forming intricate flow passages therein and fundamentally avoiding any leakage problem, which is possible because cast-in pipe inserts are applied in high-pressure casting to form flow passages and thus no separate process for machining flow passages after casting the product is required. Another object of the present disclosure is to provide a method of casting a casting product. A further object of the present disclosure is to provide a cast-in pipe insert unit.

Other objects and advantages of the present disclosure can be understood by the following description and become apparent with reference to the embodiments of the present disclosure. It is obvious to those skilled in the art to which the present disclosure pertains that the objects and advantages of the present disclosure can be realized by the means as claimed and combinations thereof.

In accordance with one aspect of the present disclosure, a method of casting a casting product having tubular flow passages comprises: attaching a cast-in pipe insert, having outer and inner fixing members to which both ends of pipes are coupled, respectively, to a fixed mold; assembling a movable mold with the fixed mold; injecting a molten metal into a cavity defined inside the fixed and movable molds; ejecting a casting product from the assembled molds after injecting the molten metal; and removing the outer and inner fixing members from the casting product.

The cast-in pipe insert may include two or more pipes.

A cone portion may be formed at the front end of the fixed mold or the movable mold wherein the cone portion is inserted through and closely coupled with the inside of the inner fixing member.

In this case, each of the outer fixing member and the inner fixing member may be of a ring shape having a circular cross section.

On the other hand, injecting the molten metal may be carried out by a high-pressure casting method.

Further, the pipes may be arranged in the cavity.

In accordance with another aspect of the present disclosure, a casting product having tubular flow passages comprises a hollow, wherein the flow passages pass through a surface of the hollow and an outer surface of the casting product, and wherein the flow passages are defined by pipes inserted as cast-in inserts.

In accordance with still another aspect of the present disclosure, a cast-in pipe insert comprises: an inner fixing member; an outer fixing member; and pipes coupled to both the outer fixing member and the inner fixing member at both ends of the pipes, respectively, wherein a cap is coupled to one end of each of the pipes respectively so that the cap is coupled to the inner fixing member or the outer fixing member.

The cap may include an insertion portion inserted into one end of the pipe and a head portion having a diameter larger than that of the insertion portion.

An outer diameter of the head portion may correspond to that of an outer diameter of the pipe.

Each of the outer fixing member and the inner fixing member may be of a ring shape having a circular cross section.

Portions of the pipe coupled to the outer fixing member and the inner fixing member may be fixed to each other by arc welding.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which.

DESCRIPTION OF SPECIFIC EMBODIMENTS

In order to fully understand the present disclosure, operational advantages of the present disclosure and objects achieved by implementing the present disclosure, the accompanying drawings exemplifying embodiments of the present disclosure and contents described in the accompanying drawings need to be referred to.

In describing the exemplary embodiments of the present disclosure, detailed description of technology known in the art or iterative description may be made shortly or omitted to avoid obscuring the subject matter of the present disclosure.

Figure 1:
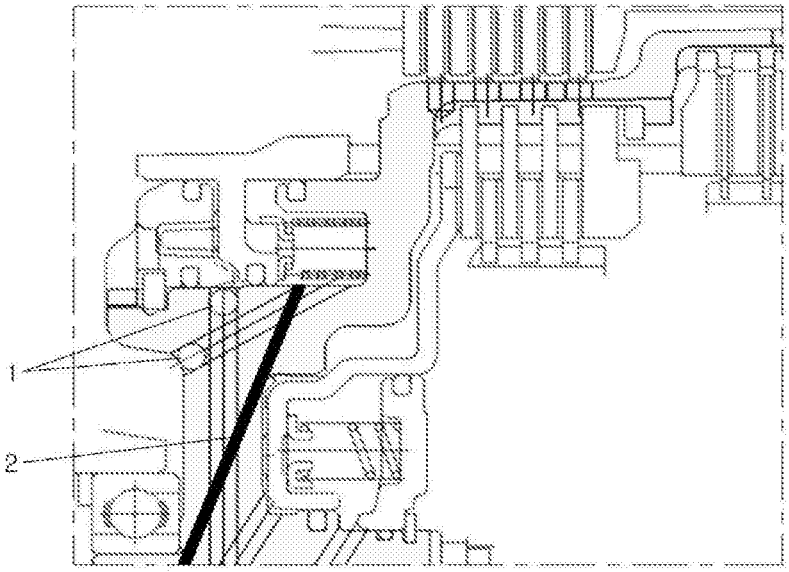
FIG.1(Prior Art)
FIGS. 1 and 2 illustrate conventional methods for forming flow passages in a casting product.
Figure 2:
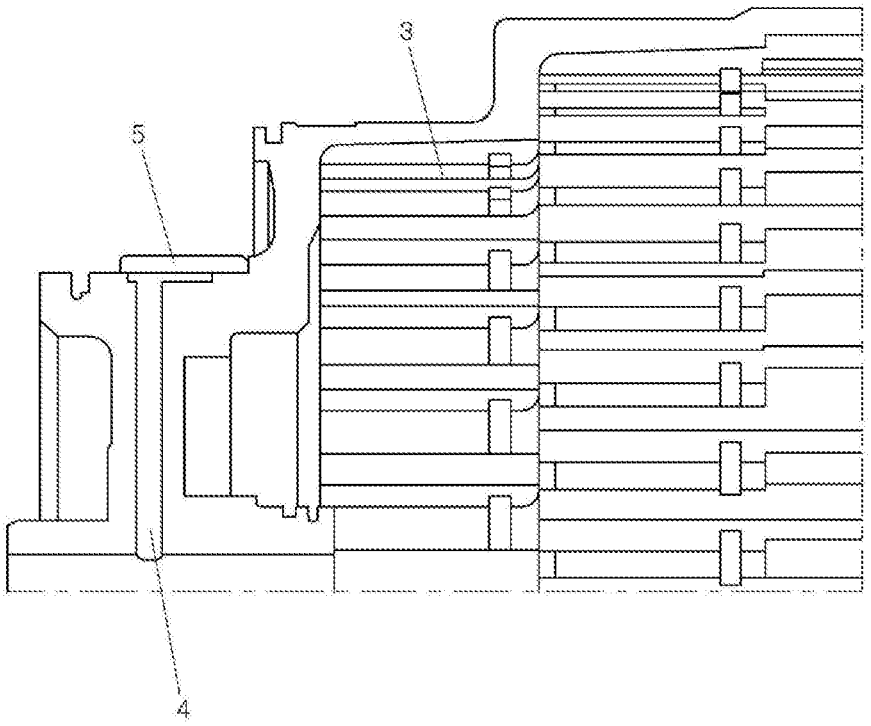
FIG.2(Prior Art)
Figure 3A:
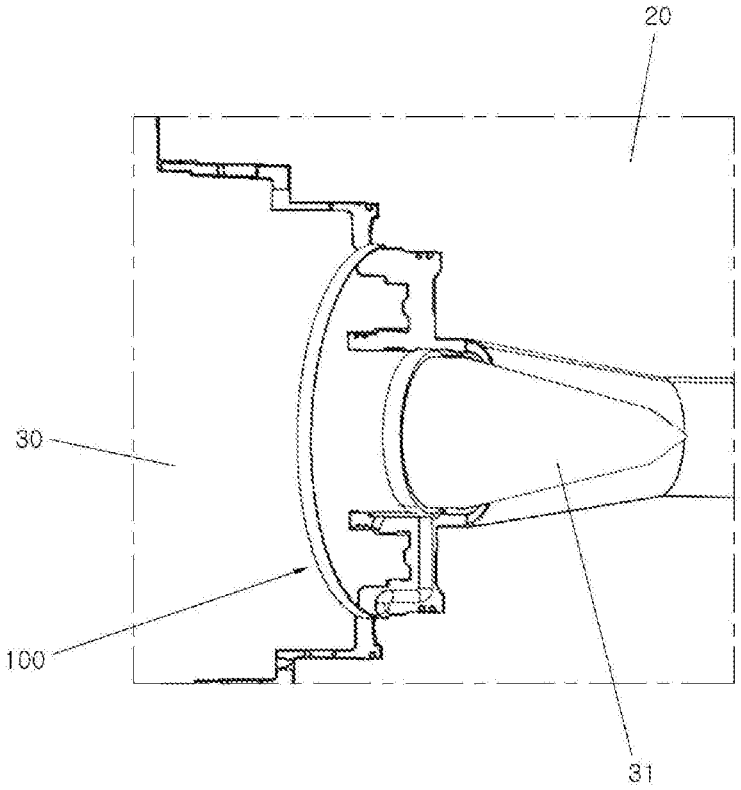
FIGS. 3A to 3C illustrate a method of casting a casting product having tubular flow passages according to an embodiment of the present disclosure.
Figure 3B:
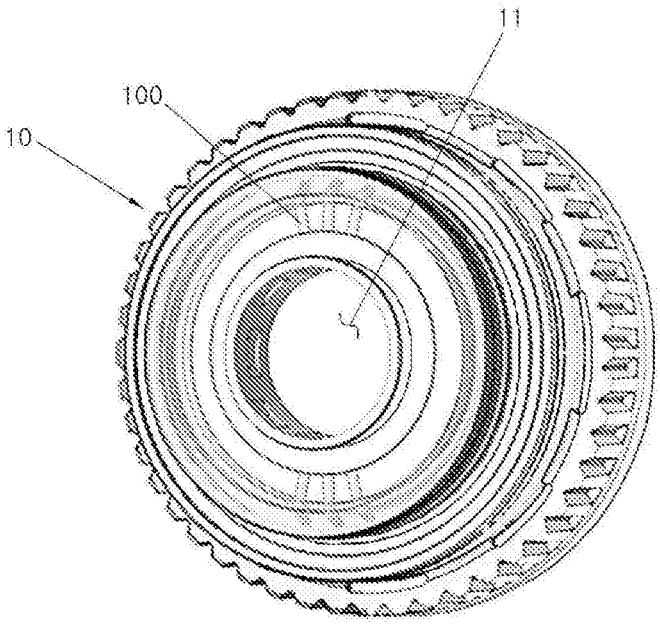
Figure 3C:
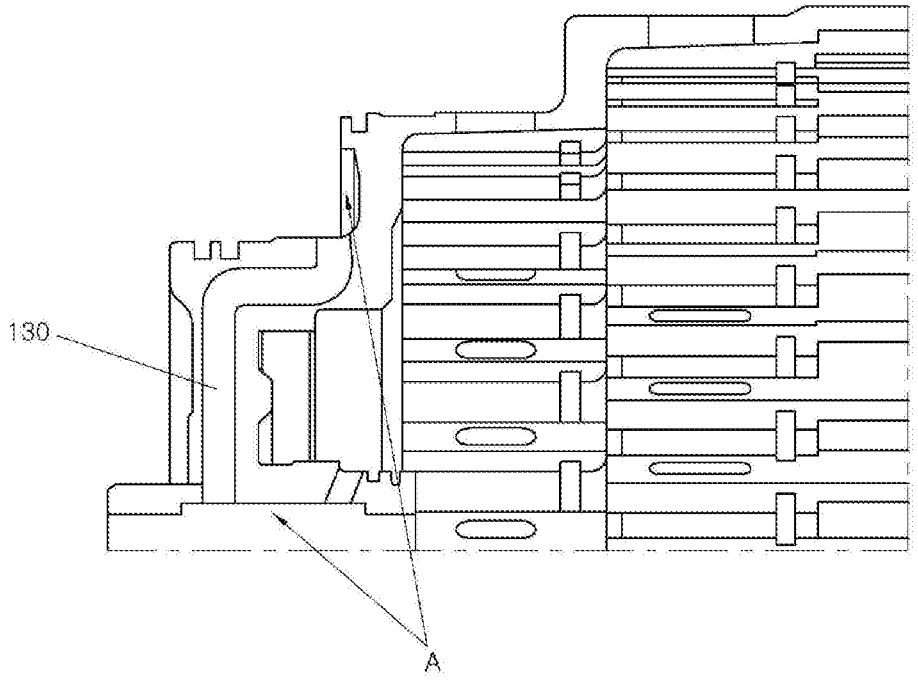
Figure 4:
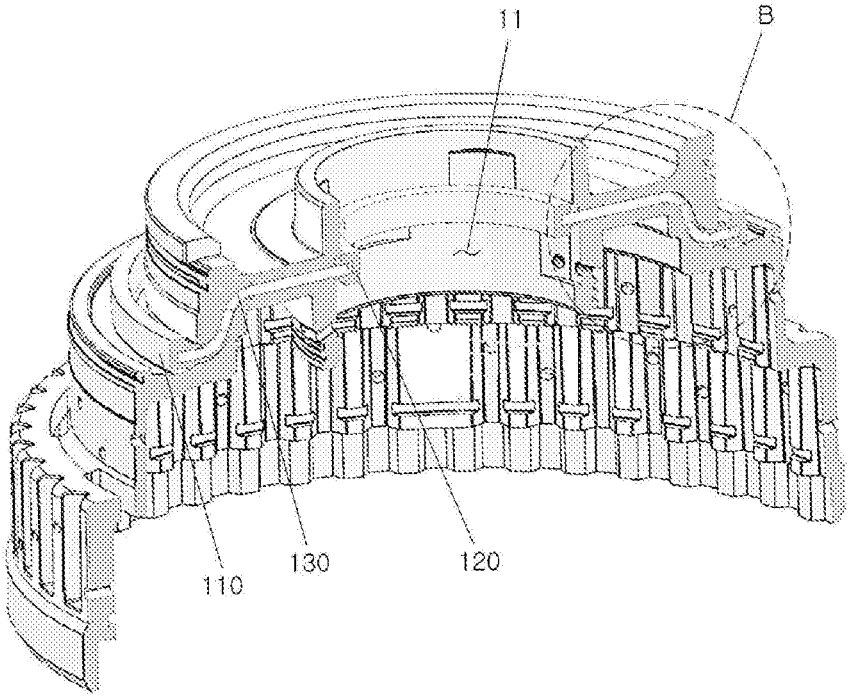
FIG. 4 is a cut-away perspective view of a casting product according to an embodiment of the present disclosure.
Figure 5:
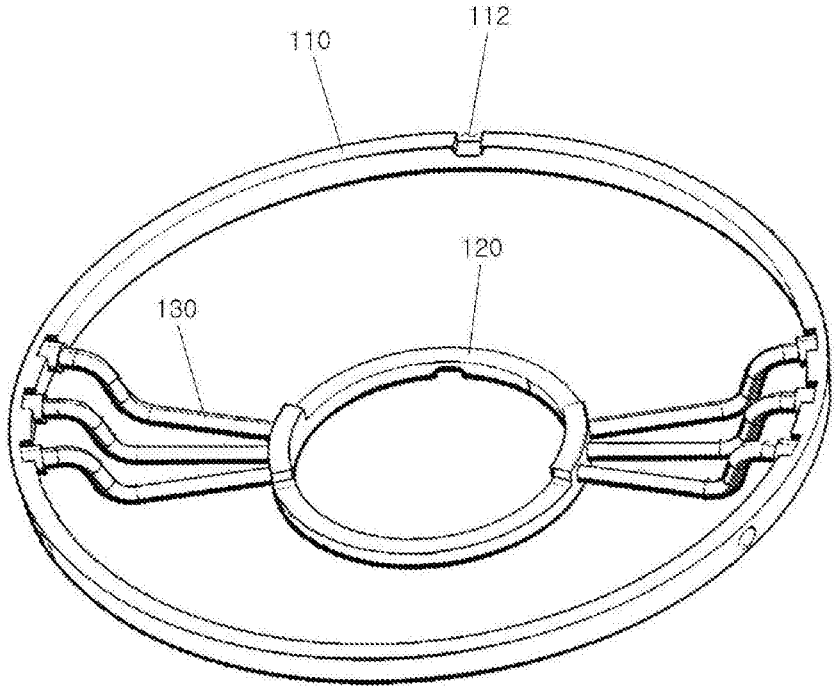
FIG. 5 illustrates a cast-in pipe insert unit to be applied to a portion B of FIG. 4.

FIGS. 3A to 3C illustrate a method of casting a casting product having tubular flow passages according to an embodiment of the present disclosure, FIG. 4 is a cut-away perspective view of a casting product according to an embodiment of the present disclosure, and FIG. 5 illustrates a cast-in pipe insert unit to be applied to a portion B of FIG. 4.

Hereinafter, a casting product having tubular flow passages, a method of casting a casting product, and a cast-in pipe insert unit according to an embodiment of the present disclosure will be described with reference to FIGS. 3A to 5.

An embodiment of the present disclosure relates to a casting product 10 having a hollow 11 formed therein and a casting method in which the casting product having the hollow 11 formed therein is casted while forming flow passages passing through a surface of the hollow and an outer surface of the casting product 10 in the casting product 10.

A cast-in pipe insert unit 100 is provided for this purpose.

In other words, this embodiment of the present disclosure is intended to form flow passages in the casting product in the state where pipes for forming the flow passages are inserted under high-pressure casting rather than by post-machining the flow passages, wherein the cast-in pipe insert unit 100 is a member for fixing to a mold the pipes to be inserted.

The cast-in pipe insert unit 100 prepared is fixed to a fixed mold 20. The cast-in pipe insert unit 100 is to fix the pipes in the mold and includes pipes, an outer fixing member and an inner fixing member wherein the outer fixing member is fixed to the fixed mold 20.

FIG. 5 illustrates an exemplary embodiment in which the outer fixing member and the inner fixing member correspond to an outer ring 110 and an inner ring 120 respectively and thus have a ring shape wherein a groove for being coupled to a mold 112 formed in the outer ring 110 is matched and fixed to a protrusion formed in a complementary fashion in the fixed mold 20. The groove for being coupled to a mold and the protrusion formed in a complementary fashion may be formed in a reverse manner between the outer ring 110 and the fixed mold 20.

In addition, this embodiment illustrates the number of pipes as six, but the number of pipes may vary depending on casting products. The pipe may be one, but two or more pipes are more preferable in terms of fixing.

However, the outer fixing member and the inner fixing member do not necessarily have to be circular rings and their shapes may vary depending on flow passages to be formed.

Then, a movable mold 30 is moved and assembled with the fixed mold 20.

A shape of a cavity formed by the assembled movable and fixed molds 30 and 20 are defined by opposing surfaces of the movable mold 30 and the fixed mold 20, which are formed to match with a shape of the casting product to cast. A cone portion 31 is formed at the front end of the movable mold 30. The cone portion 31 is inserted through and closely coupled with the inside of the inner fixing member.

In the exemplary embodiment, although the cone portion 31 is formed at the front end of the movable mold 30, the cone portion 31 may be formed at the front end of the fixed mold 20.

Then, casting is carried out by injecting molten metal into the cavity. The casting may be carried out by a high-pressure casting method.

At this time, pipes 130 for forming flow passages are disposed in the cavity so that the pipes 130 are embedded between the surface of the hollow and the outer surface of the casting product 10.

Then, after being cooled and ejected, a casting product 10 having the pipes 130 embedded and the hollow 11 formed therein as shown in FIG. 3B is obtained.

Referring to FIG. 3C which is a partial cross-sectional view of FIG. 3B, the casting product is finished by machining both ends A of the pipe 130 to remove the outer and inner fixing members.

FIG. 4 shows the state before the outer ring 110 and the inner ring 120 are removed. When the outer ring 110 and the inner ring 120 are removed by machining, only the pipe 130 is left in the casting product 10.

Figure 6:
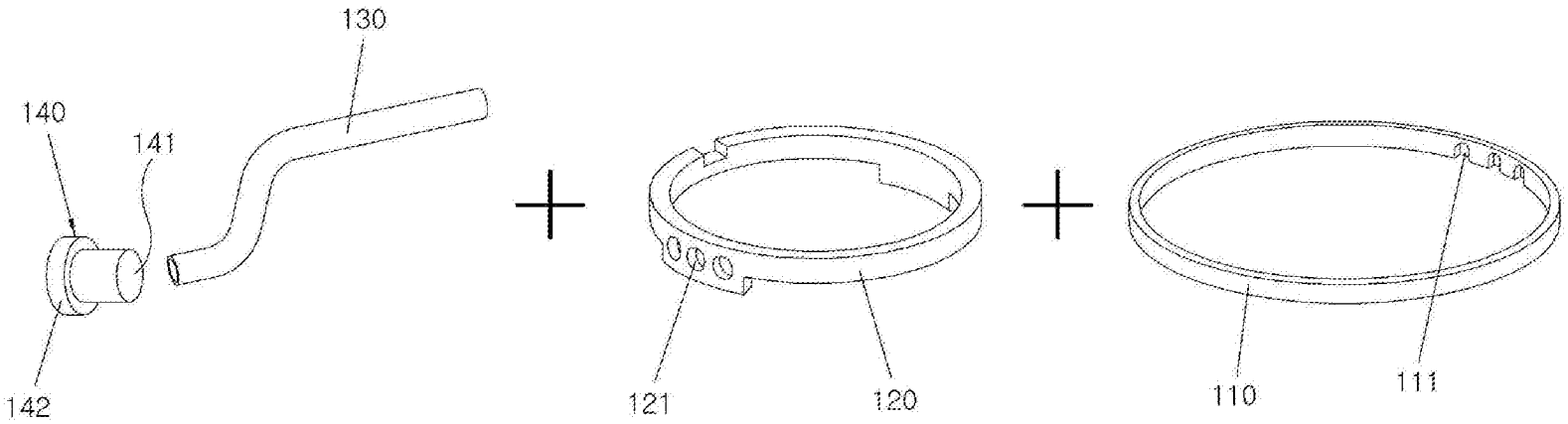
FIGS. 6 to 8 illustrates a method of manufacturing a cast-in pipe insert unit according to an embodiment of the present disclosure.
Figure 7:
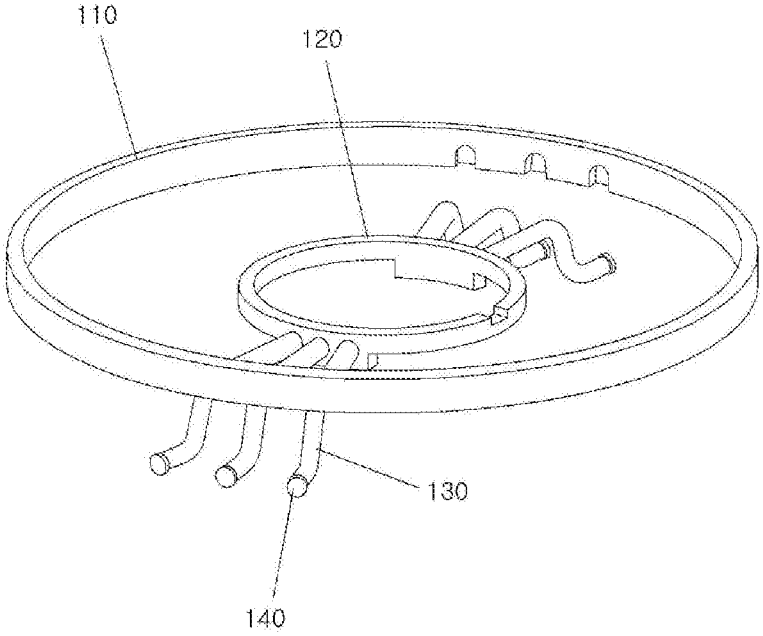
Figure 8:
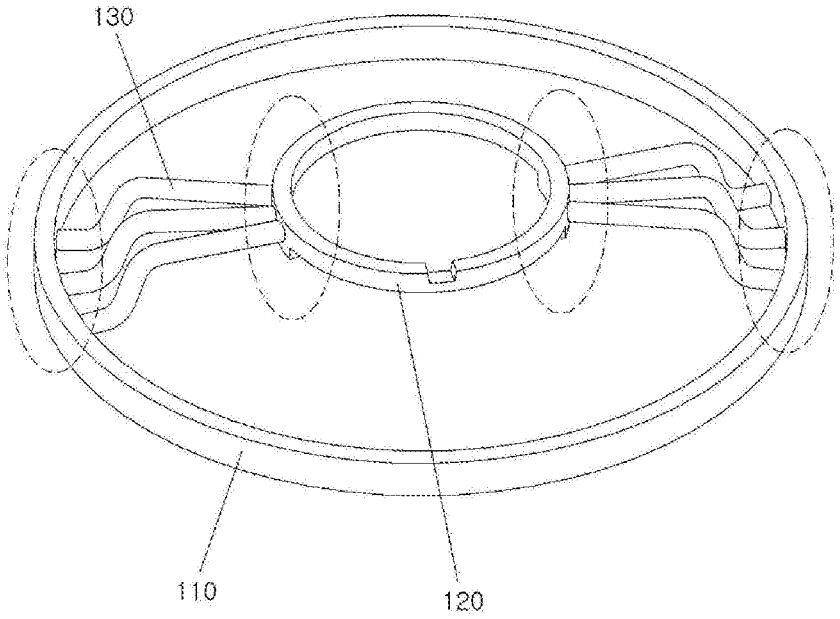

FIGS. 6 to 8 illustrate a method of manufacturing the cast-in pipe insert unit according to an embodiment of the present disclosure.

First, a cap 140 is coupled to one end of the pipe 130.

The pipe 130 may be subjected to a bending process in advance according to design of flow passages.

One end of the pipe 130 is coupled to the inner ring 120 while the other end is coupled to the outer ring 130.

The inner ring 120 is formed with inner coupling grooves 121 into which one end of the pipe 130 is inserted so that one end of the pipe 130 can be press-fitted into the inner coupling groove 121 as shown in FIG. 7.

The cap 140 is coupled to the other end of the pipe 130 and the cap 140 is press-fitted into an outer coupling groove 111 formed in the outer ring 110.

Coupling by means of the cap 140 also serves to improve performance of pressure resistance during casting as described later. Although the cap 140 is coupled to one end of the pipe 130 coupled to the outer ring 110 in this embodiment of the present disclosure, the cap 140 may be coupled to one end of the pipe 130 coupled to the inner ring 120, or otherwise both ends of the pipe 130.

In other words, it is preferable that the cap 140 is coupled to either one of both ends of the pipe 130, on which greater casting pressure is imparted. The cap 140 serves to couple the ends of the pipe to the inner ring 120 or the outer ring 110. Coupling the cap to the inner ring 120 or the outer ring 110 may be performed by any other coupling methods rather than by press fitting it into the coupling groove.

In FIG. 6, the cap 140 is shown exaggeratedly as compared with the pipe 130 for the sake of explanation. However, the cap 140 is configured such that it is composed of an insertion portion 141 and a head portion 142 having a diameter larger than that of the insertion portion 141 and that the insertion portion 141 is inserted into one end of the pipe 130 and the outer diameter of the head portion 142 and the outer diameter of the pipe 130 have corresponding sizes.

As shown in FIG. 8, the cast-in pipe insert unit 100 is finished after coupling the pipes 130 and then welding the welding portions indicated with dotted lines in the figure. Here, it is more preferable that the welding is arc welding.

Figure 9:
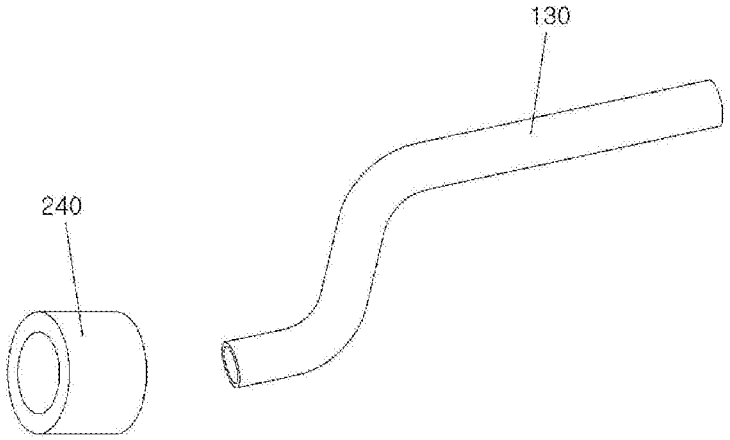
FIG. 9 illustrates a cast-in pipe insert unit according to a comparative example.

In other words, the cast-in pipe insert unit 100 according to the embodiment of the present disclosure utilizes the cap 140 and arc welding. On the contrary, if an adapter 240 shown as a comparative example in FIG. 9 is utilized and it is coupled to the pipe by brazing, a problem of physical property deterioration may occur.

Although airtightness of the flow passages can be ensured by using insert pipes, there is a possibility that molten metal may flush into the inside of the pipes during high pressure casting.

Figure 10:
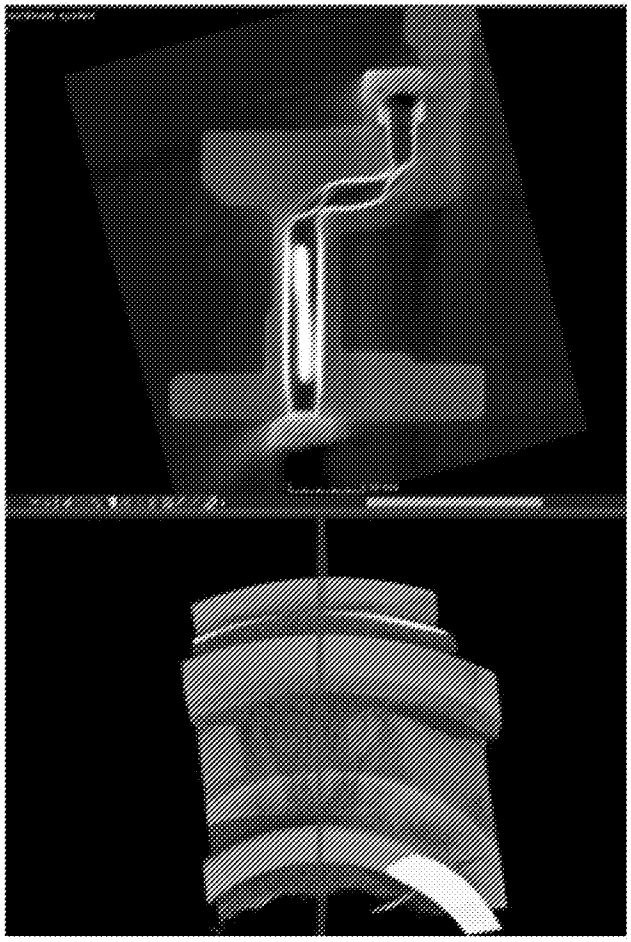
FIG. 10 photographs showing a cross-section of a high-pressure casting product to which the comparative example of FIG. 9 is applied.

Typically, brazing is used to seal pipes. Such a brazing method is advantageous in that low melting point metal such as copper is inserted into a joint after joining between the ring and the pipe by means of the cylindrical adapter 240 manufactured separately and then maintains them for a long time at a high temperature and as a result, airtightness can be completely secured by means of the low melting point metal. However, as the pipe is exposed to high temperature for a long time when brazing and hence physical properties of raw material of the pipe is deteriorated, the pipe may be deformed during high-pressure casting as shown in FIG. 10.

In other words, if compression strength of the raw material of the pipe is 9.33 kN, it is lowered to 2.95 kN at the time of brazing, which is about ⅓ or less of the initial compression strength, resulting in compression of the pipe.

Therefore, in order to overcome such deterioration of physical properties due to brazing, this embodiment of the present disclosure adopts arc welding to avoid deformation of the pipe during high-pressure casting. The arc welding is advantageous in that it is simpler in terms of process and more inexpensive compared to the brazing and it is simpler in terms of equipment and more inexpensive compared to laser welding.

However, in the case of the arc welding, it may possibly difficult to secure airtightness between the ring and the pipe. Therefore, this embodiment of the present disclosure adopts the cap 140 to be inserted into the pipe 130 in order to secure airtightness.

Figure 11A:
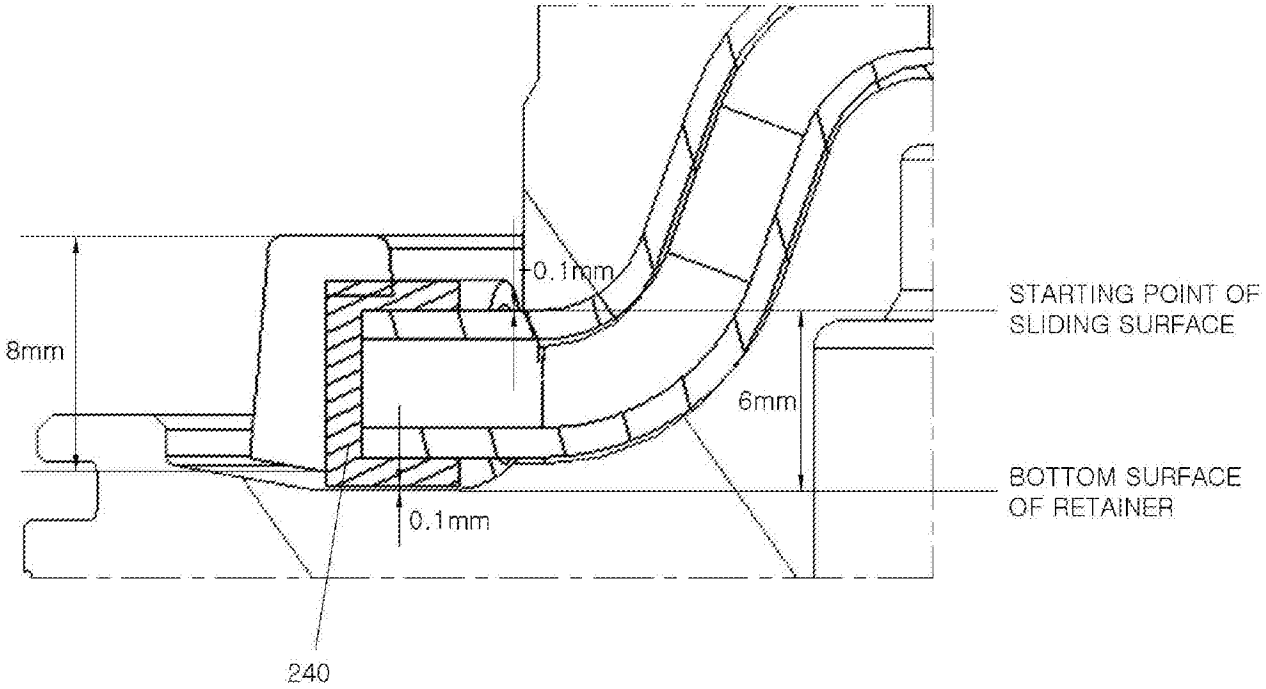
FIG. 11A is a partial cross-sectional view of a high-pressure casting product to which the comparative example of FIG. 9 is applied.
Figure 11B:
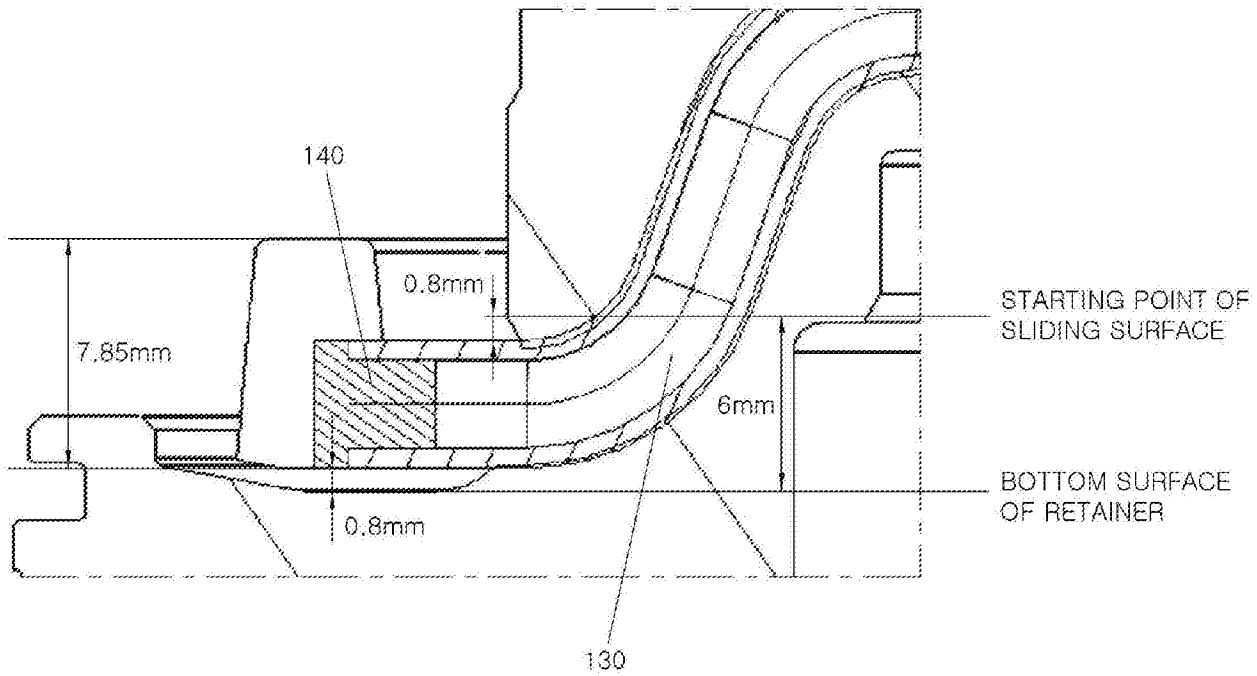
FIG. 11B is a partial cross-sectional view of a high-pressure casting product according to an embodiment of the present disclosure.

Further, FIG. 11A shows a partial cross-section of the high-pressure casting product to which the adapter 240 is applied, while FIG. 11B shows a partial cross-section of the high-pressure casting product to which the cap 140 of this embodiment of the present disclosure is applied. As can be seen from these figures, in the case where the cap 140 of this embodiment of the present disclosure is applied, there is no portion protruding to the outside as compared with the conventional adapter for brazing, which is advantageous for securing a certain clearance between the outer diameter of the pipe and the machined surface of the casting.

Figure 12A:
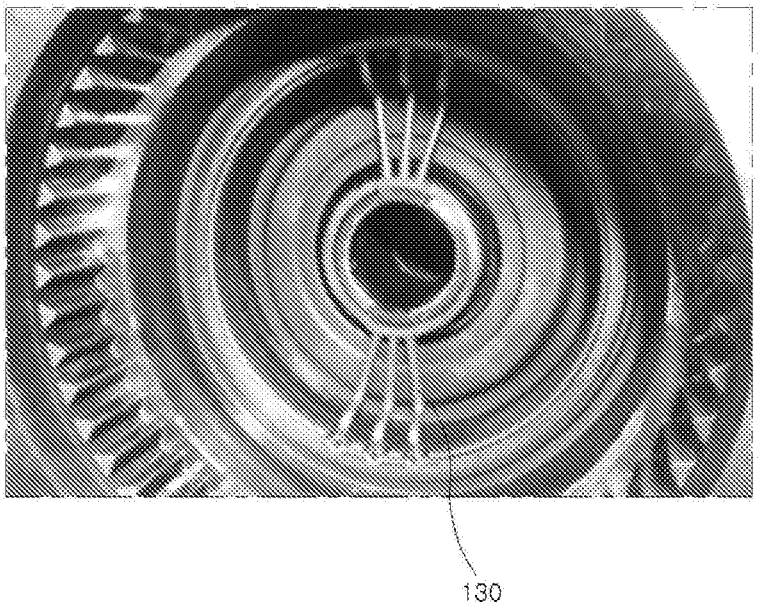
FIG. 12A is a photograph of a mold to which a cast-in pipe insert unit according to an embodiment of the present disclosure is applied.
Figure 12B:
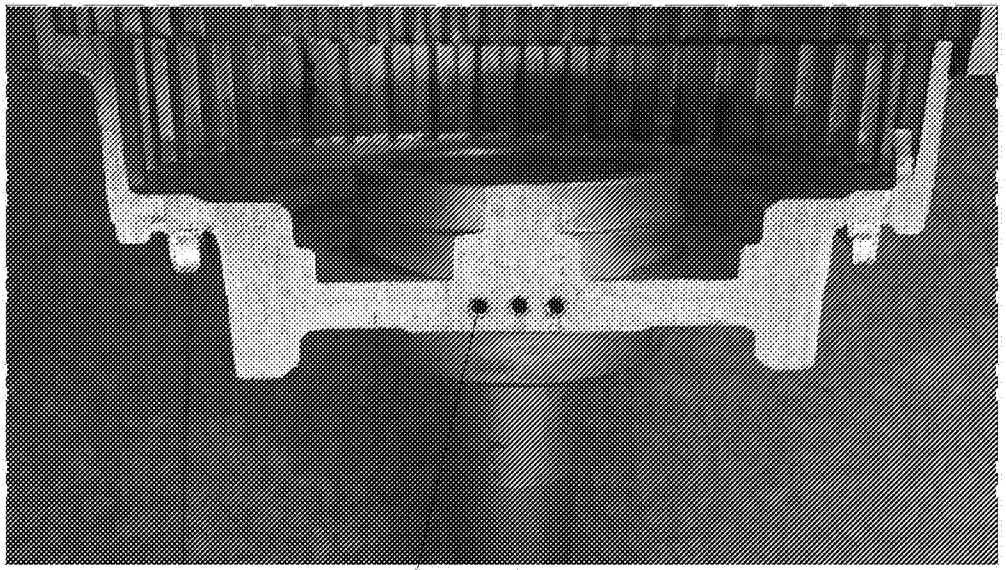
FIG. 12B is a photograph showing an actual cross-section of a high-pressure casting product according to an embodiment of the present disclosure.
Figure 13:
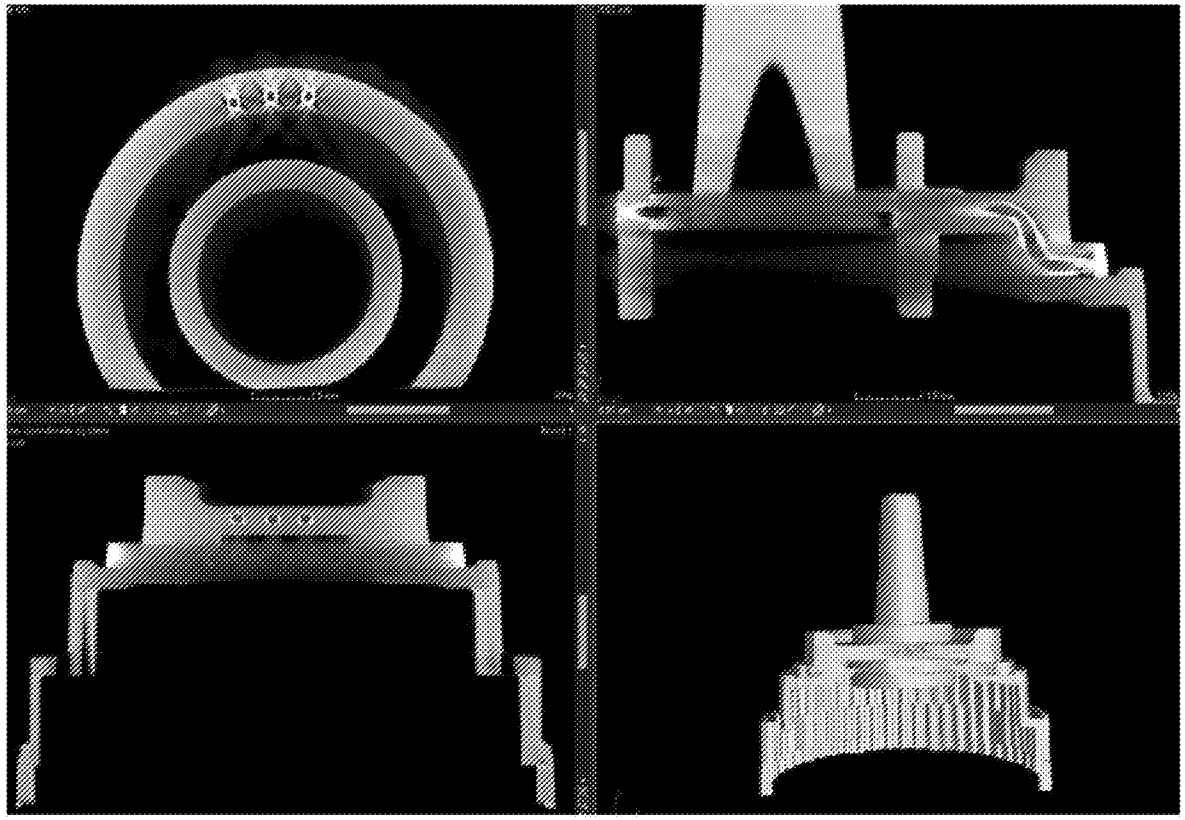
FIG. 13 shows several CT photographs for demonstrating cross sections of a high-pressure casting product according to an embodiment the present disclosure.

FIG. 12A is a photograph of a mold to which a cast-in pipe insert unit according to an embodiment of the present disclosure is actually applied, and FIG. 12B is a photograph showing an actual cross-section of a high-pressure casting product according to an embodiment of the present disclosure. FIG. 13 shows several CT photographs for demonstrating cross sections of a high-pressure casting product according to an embodiment the present disclosure. As described above, in the cast-in pipe insert unit 100 of this embodiment of the present disclosure, the cap to be inserted into the pipe is utilized to fix the pipe to the outer fixing member and the welding portions are welded by arc welding instead of brazing. Consequently, as can be seen from FIGS. 12B and 13, it is demonstrated that flow passages are formed well by the pipes 130 without deformation of the pipes.

As described above, embodiments of the present disclosure has advantageous effect that casting process can be carried out in the state in which the pipes are stably fixed in the mold by means of the cast-in pipe insert unit, no deformation of the pipes occurs during casting process, and quality of the casting product is also improved by virtue of casting process carried out in the state in which the pipes are inserted in the mold.

Figure 14A:
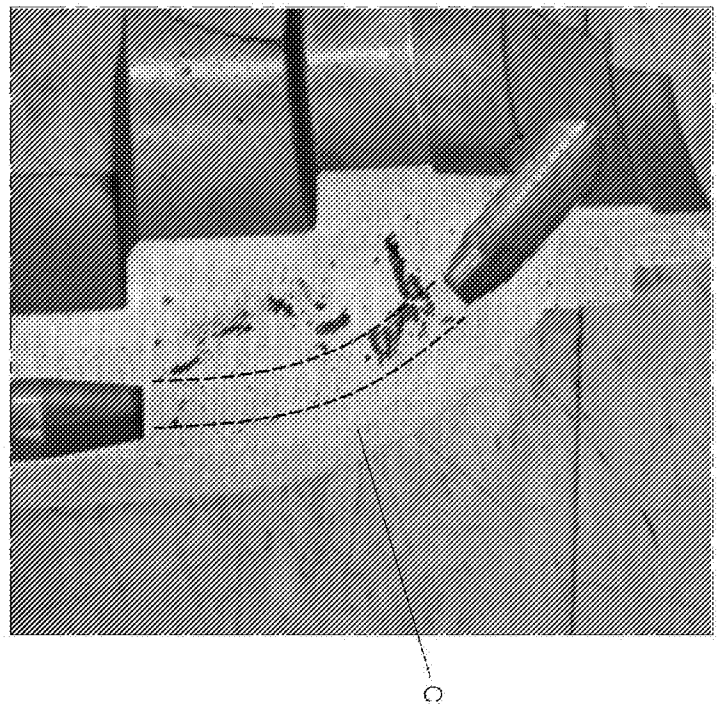
FIGS. 14A and 14B are photographs for demonstrating how internal shrinkage of an aluminum casting product is suppressed depending on whether to apply a cast-in pipe insert unit.
Figure 14B:
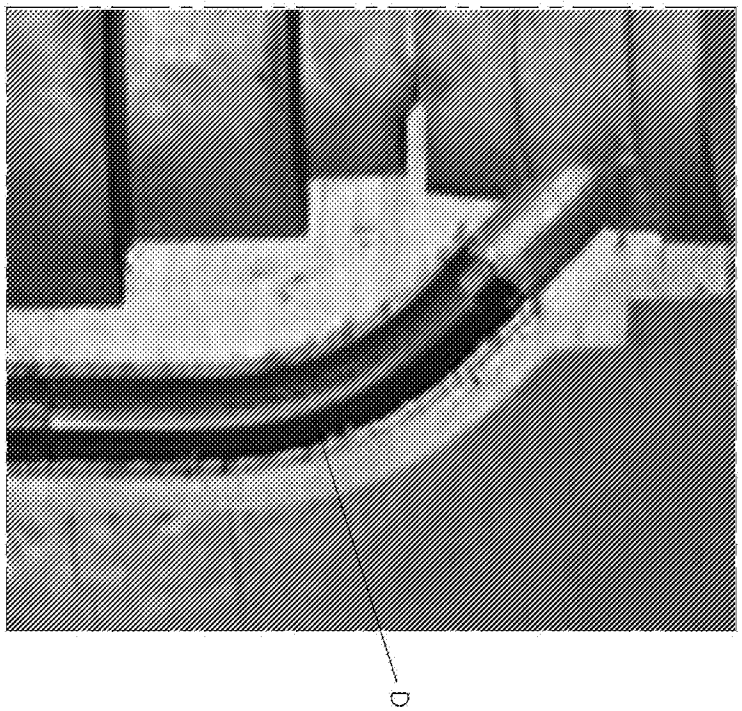

Referring to FIGS. 14A and 14B, FIG. 14A depicts the interior of an aluminum casting product to which no pipe insert is applied, while FIG. 14B shows an example in which internal shrinkage is suppressed in an aluminum casting product manufactured in the state where the pipe is inserted in the mold.

The examples shown in these figures are a deep carrier case. In the example as shown in FIG. 14A, leakage occurs due to shrinkage defect in a thick portion C. That is, leakage is likely to occur when machining the casting product passes through the defective portion in the thick portion. On the contrary, the example as shown in FIG. 14B demonstrates that shrinkage defect is improved when casting process is carried out in the state where a steel pipe is inserted in the mold. The reason is that volume of the casting is reduced due to reduction of thickness of the casting by virtue of insertion of inserts and thus cooling effect is increased whereby solidification shrinkage is suppressed in the process of casting to solidification.

According to embodiments of the present disclosure, cast-in pipe inserts are applied in casting a casting product to form flow passages and thus no separate process for machining flow passages after casting the product is required so that it is possible to fundamentally solve any leakage problem and form intricate flow passages in the casting product.

Although the present disclosure has been described in the foregoing with reference to the drawings illustrated by way of an example, the present disclosure is not limited to the disclosed embodiments and it is apparent to those of ordinary skill in the art that various modifications and variations can be made to the present disclosure without departing from the spirit and scope of the disclosure. Therefore, such modifications or variations fall within the scope of the present disclosure as claimed and the scope of the present disclosure should be interpreted based on the appended claims.

What is claimed is:

1. A method of casting a casting product having tubular flow passages, comprising:

attaching a cast-in pipe insert, having outer and inner fixing members to which both ends of pipes are coupled, respectively, to a fixed mold;

assembling a movable mold with the fixed mold;

injecting a molten metal into a cavity defined inside the fixed and movable molds;

ejecting a casting product after injecting the molten metal; and removing the outer and inner fixing members from the casting product, wherein the fixed mold or the movable mold has a cone portion at a front end thereof, wherein the cone portion is inserted through and coupled with an inner side of the inner fixing member, wherein each of the outer fixing member and the inner fixing member has a ring shape having a circular cross section, wherein a diameter of the inner fixing member is smaller than a diameter of the outer fixing member, wherein the inner fixing member is disposed inside the outer fixing member.

2. The method according to claim 1, wherein the cast-in pipe insert includes two or more pipes.

3. The method according to claim 1, wherein the injecting a molten metal is carried out by a high-pressure casting.

4. The method according to claim 1, wherein the pipes are arranged in the cavity.

* * * * *